US007509893B2

(12) United States Patent
Wu

(10) Patent No.: US 7,509,893 B2
(45) Date of Patent: Mar. 31, 2009

(54) LOCKING DEVICE FOR LOCKING PIVOTABLE HEAD OF HAND TOOL

(75) Inventor: Arthur Wu, Taichung County (TW)

(73) Assignee: Proxene Tools Co., Ltd., Taichung County ( * ) Notice: Subject to any disclaimer, the term of this patent is extended or adjusted under 35 U.S.C. 154(b) by 12 days.

(21) Appl. No.: 11/819,342

(22) Filed: Jun. 27, 2007

(65) Prior Publication Data

US 2009/0000430 A1 Jan. 1, 2009

(51) Int. Cl.
*B25B 23/16* (2006.01)

(52) U.S. Cl. ..... 81/177.8; 81/177.9

(58) Field of Classification Search ..... 81/177.7–177.9
See application file for complete search history.

(56) References Cited

U.S. PATENT DOCUMENTS

| | | | | |
|---|---|---|---|---|
| 1,370,839 | A * | 3/1921 | Redenbaugh | 81/177.8 |
| 6,877,404 | B2 * | 4/2005 | Chen | 81/177.7 |
| 6,971,292 | B2 * | 12/2005 | Hu | 81/177.8 |
| 7,000,507 | B1 * | 2/2006 | Lin | 81/177.9 |
| 7,082,862 | B2 * | 8/2006 | Lee | 81/177.8 |
| 7,165,480 | B2 * | 1/2007 | Lin | 81/177.9 |
| 7,174,815 | B1 * | 2/2007 | Hsieh | 81/177.9 |
| 7,197,966 | B1 * | 4/2007 | Hsieh | 81/177.9 |
| 7,318,366 | B2 * | 1/2008 | Lee et al. | 81/177.9 |
| 7,401,538 | B2 * | 7/2008 | Cheng | 81/177.9 |
| 2003/0015070 | A1 * | 1/2003 | Chen | 81/177.9 |
| 2004/0144219 | A1 * | 7/2004 | Lin | 81/177.8 |
| 2004/0261586 | A1 * | 12/2004 | Chen | 81/177.7 |
| 2005/0016332 | A1 * | 1/2005 | Hu | 81/177.8 |
| 2005/0061117 | A1 * | 3/2005 | Chen | 81/177.7 |
| 2005/0103168 | A1 * | 5/2005 | Wei | 81/177.7 |
| 2005/0268753 | A1 * | 12/2005 | Lin | 81/177.9 |
| 2005/0274234 | A1 * | 12/2005 | Lee | 81/177.8 |
| 2006/0042425 | A1 * | 3/2006 | Lin | 81/177.9 |
| 2006/0174733 | A1 * | 8/2006 | Hsieh | 81/177.8 |
| 2007/0283790 | A1 * | 12/2007 | Cheng | 81/177.9 |

* cited by examiner

*Primary Examiner*—D. S Meislin

(57) ABSTRACT

A hand tool locking device for a hand tool includes a switch member having a shank which is rotatably inserted in a recess defined in the head of the hand tool and the shank includes a convex and curved surface and a flat surface. A pawl and a spring are received in a passage defined in an inside of the yoke of the head of the hand tool. The pawl has teeth defined in a first end thereof and the teeth are pushed to engage with engaging teeth of the pivotable tool head when the convex and curved surface of the shank pushes a second end of the pawl toward the tool head. When the shank is rotated to let the flat surface to contact the second end of the pawl, the teeth of the pawl are disengaged from the engaging teeth of the pivotable tool head.

8 Claims, 9 Drawing Sheets

LOCKING DEVICE FOR LOCKING PIVOTABLE HEAD OF HAND TOOL

BACKGROUND OF THE INVENTION (1) Field of the Invention

The present invention relates to a locking device for locking a pivotable head of a hand tool and the pawl of the device is well positioned during operation and the parts of the device are easily manufactured.

(2) Description of the Prior Art

A conventional locking device for locking pivotable head of a hand tool is disclosed in U.S. Pat. No. 5,199,335. However, the locking device of U.S. Pat. No. 5,199,335 includes inherent shortcomings which make the hand tool to be difficult manufactured and the main part tends to shake. The locking spool includes teeth defined in the shank thereof and the teeth are defined along inward curved surface which makes the teeth to be difficult to be manufactured. Because of the difficulties of manufacture of the teeth defined in the locking spool, the teeth might not be perfectly engaged with the teeth of hub of the tool head. This might lead unstable operation of the tool head. Besides, the recess of the yoke is too long so that the lugs of the yoke might be deformed during quenching process and the head tool might shake during operation. The teeth of the locking spool are opened to outside of the hand tool and foreign objects such as metal debris or dust might be attached to the teeth and affect the locking feature. Furthermore, the bead is directly engaged with the teeth of the locking spool so that the bead might be engaged with the root of the teeth or positioned on a peak of one of the teeth. The precision of locking feature is not satisfied.

The present invention intends to provide a locking device which is located in the handle and the movement of the pawl to move to engage with or disengage from the too head is precisely controlled by the switch member which includes a curved surface which pushes the pawl toward the tool head and a flat surface which allows the pawl to be pushed by a spring and away from the tool head.

SUMMARY OF THE INVENTION

The present invention relates to a hand tool and comprises a handle with a yoke on one end thereof and a space is defined between two lugs of the yoke so that an insertion of a tool head is pivotably connected between the two lugs. A recess is defined in one side of the handle and a first passage is defined longitudinally in an inside of the yoke. The recess communicates with the passage and a shank of a switch member is rotatably inserted in the recess. The shank includes a convex and curved surface and a flat surface defined in an outer periphery thereof. A lever extends from a top of the shank and located on the side of the handle. A pawl and a first spring are received in the first passage and the pawl has teeth defined in a first end thereof so as to be removably engaged with engaging teeth defined in the insertion of the tool head. The teeth are pushed to engage with the engaging teeth of the insertion when the second end of the pawl is pushed by the convex and curved surface of the shank, and the teeth are removed from the engaging teeth of the insertion when the second end of the pawl is in contact with the flat surface of the shank.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
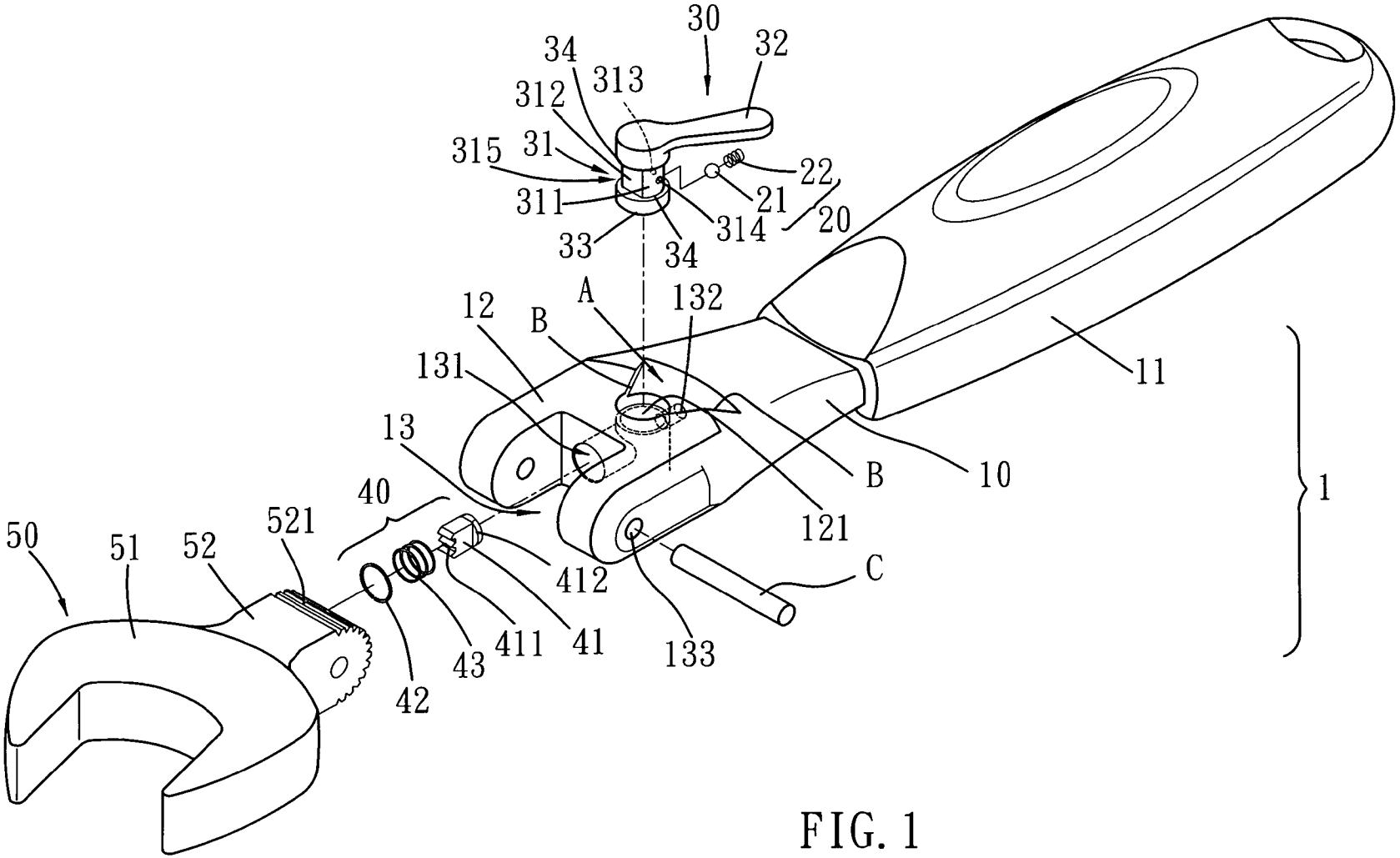
FIG. 1 is an exploded view to show the hand tool of the present invention.
Figure 2:
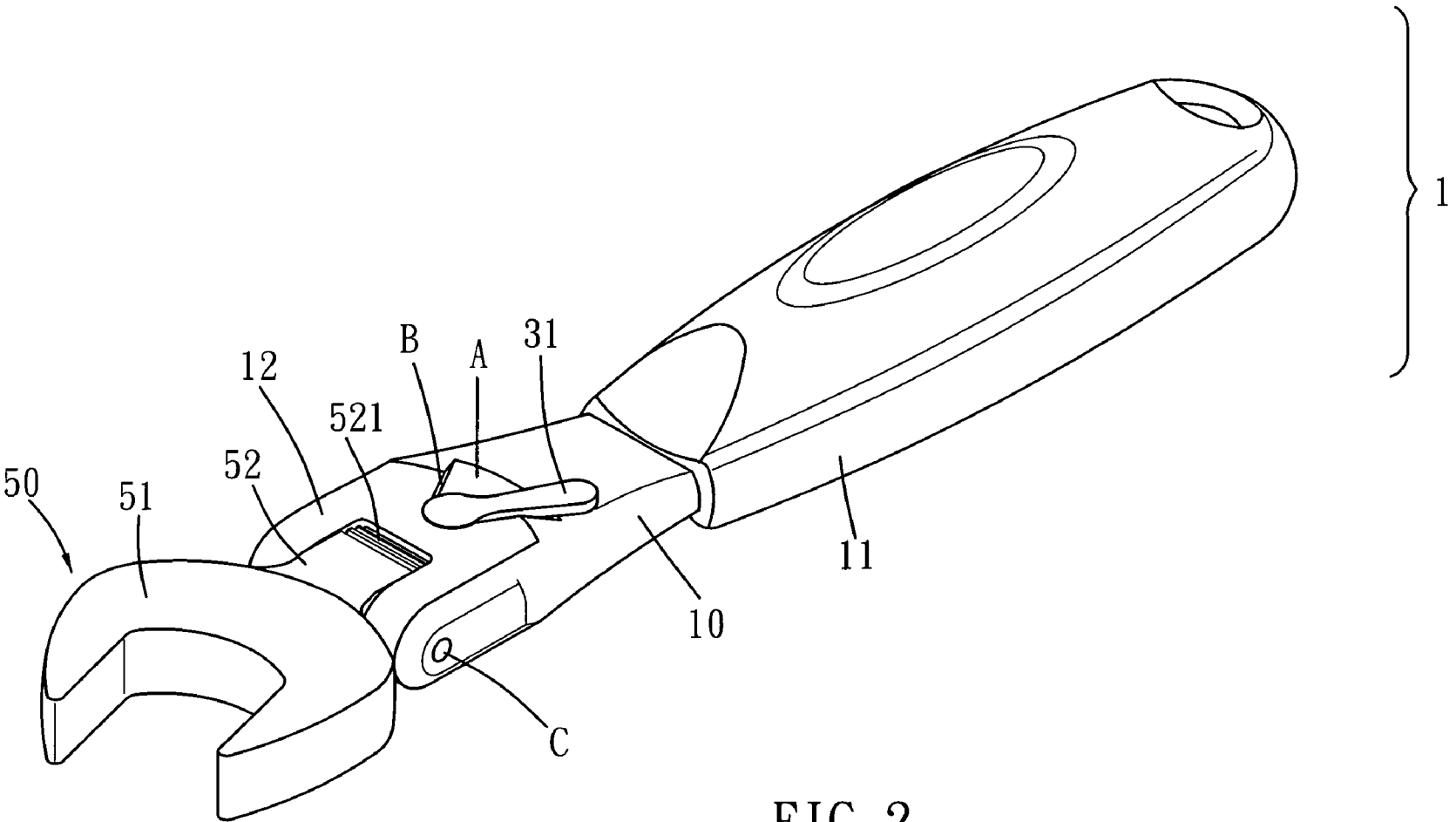
FIG. 2 is a perspective view to show the hand tool of the present invention.

Referring to FIGS. 1 to 5, the hand tool 1 of the present invention comprises a handle 10 having a yoke 12 on one end thereof and a grip 11 on the other end of the handle 10. A space 13 is defined between two lugs of the yoke 12 and each lug includes a hole 133. A recess 121 is defined in one side of the handle 10 and a first passage 131 is defined longitudinally in an inside of the yoke 12, the recess 121 communicating with the passage 131. A second passage 132 is defined longitudinally in the handle 10 and communicates with the recess 121, the recess 121 is located between the first and second passages 131, 132, A switch member 30 has a shank 31 which is rotatably inserted in the recess 121 and includes a convex and curved surface 311 and a flat surface 312 defined in an outer periphery thereof. A lever 32 extends from a top of the shank 31 and located on the side of the handle 10. The shank 31 includes two enlarged portions 33 on the top and a bottom thereof.

Figure 4:
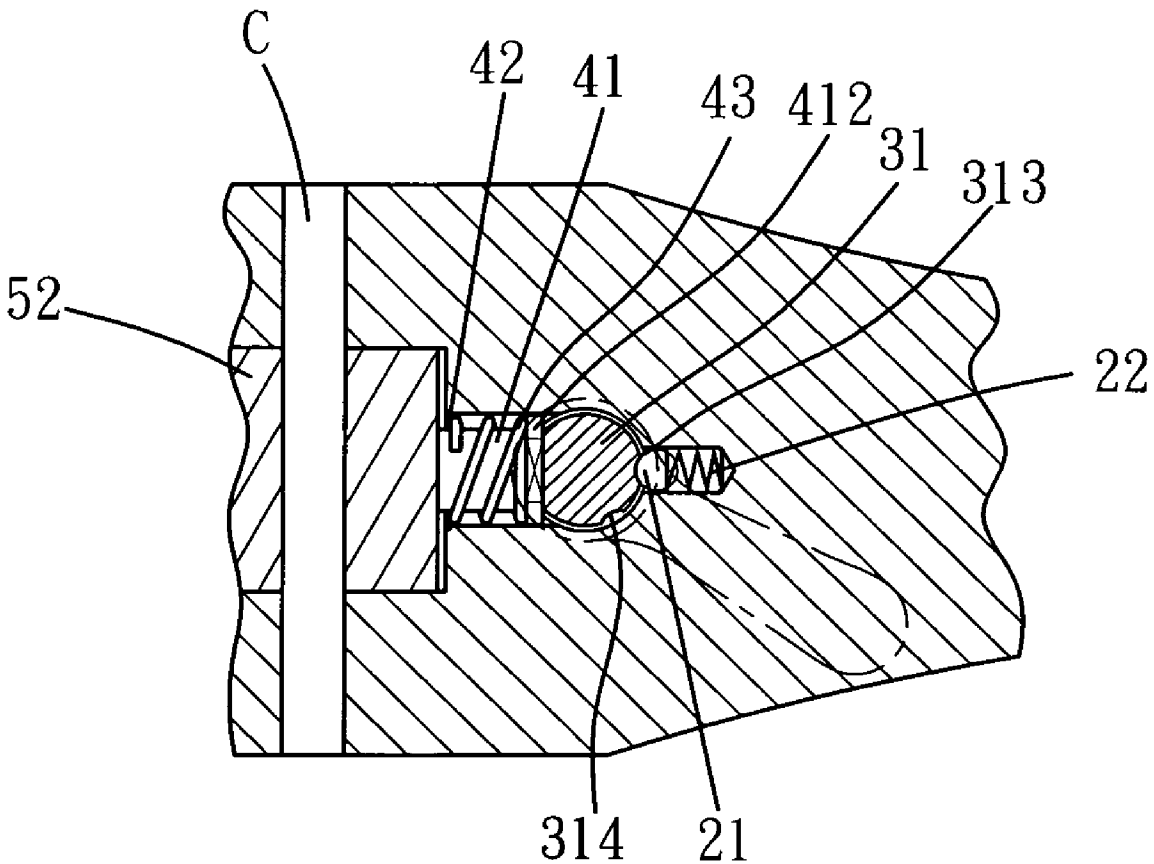
FIG. 4 is a cross sectional view to show the bead is engaged with one of the notches in the shank and the flat surface of the shank is in contact with the pawl.
Figure 5:
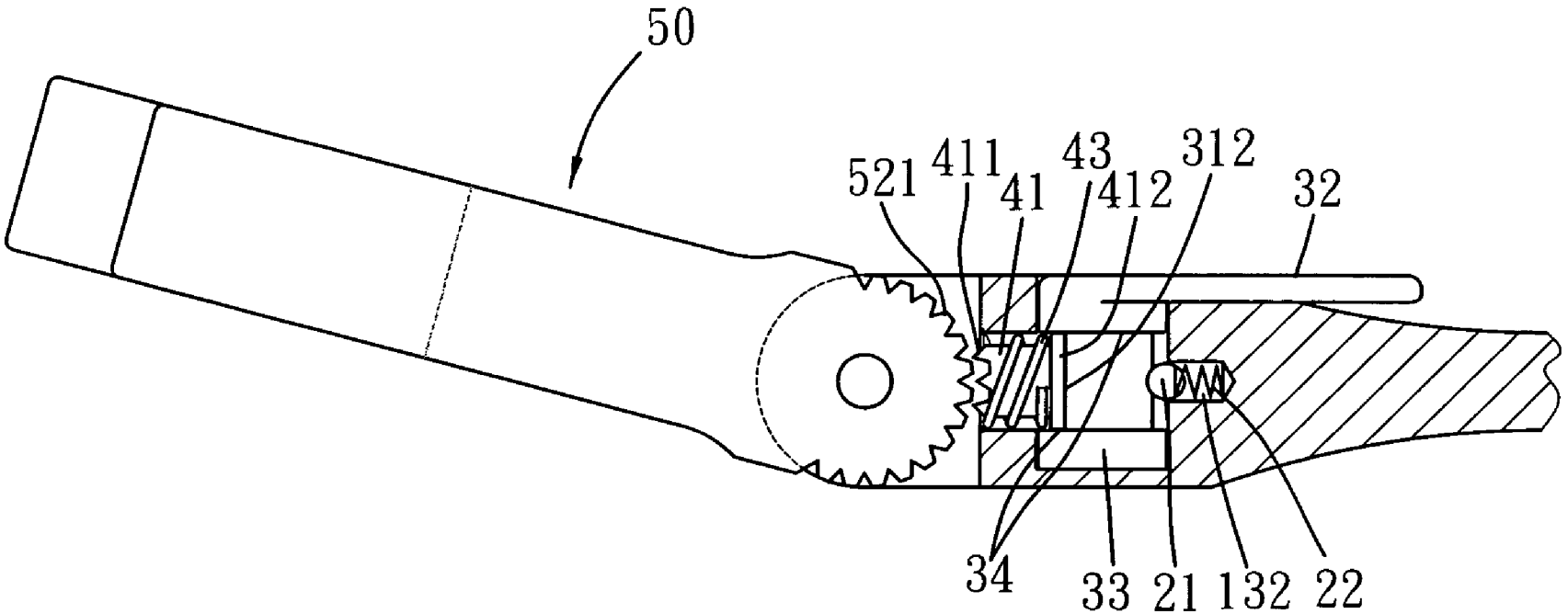
FIG. 5 shows that the pawl is disengaged from the engaging teeth of the tool head when the flat surface of the shank is in contact with the pawl.
Figure 6:
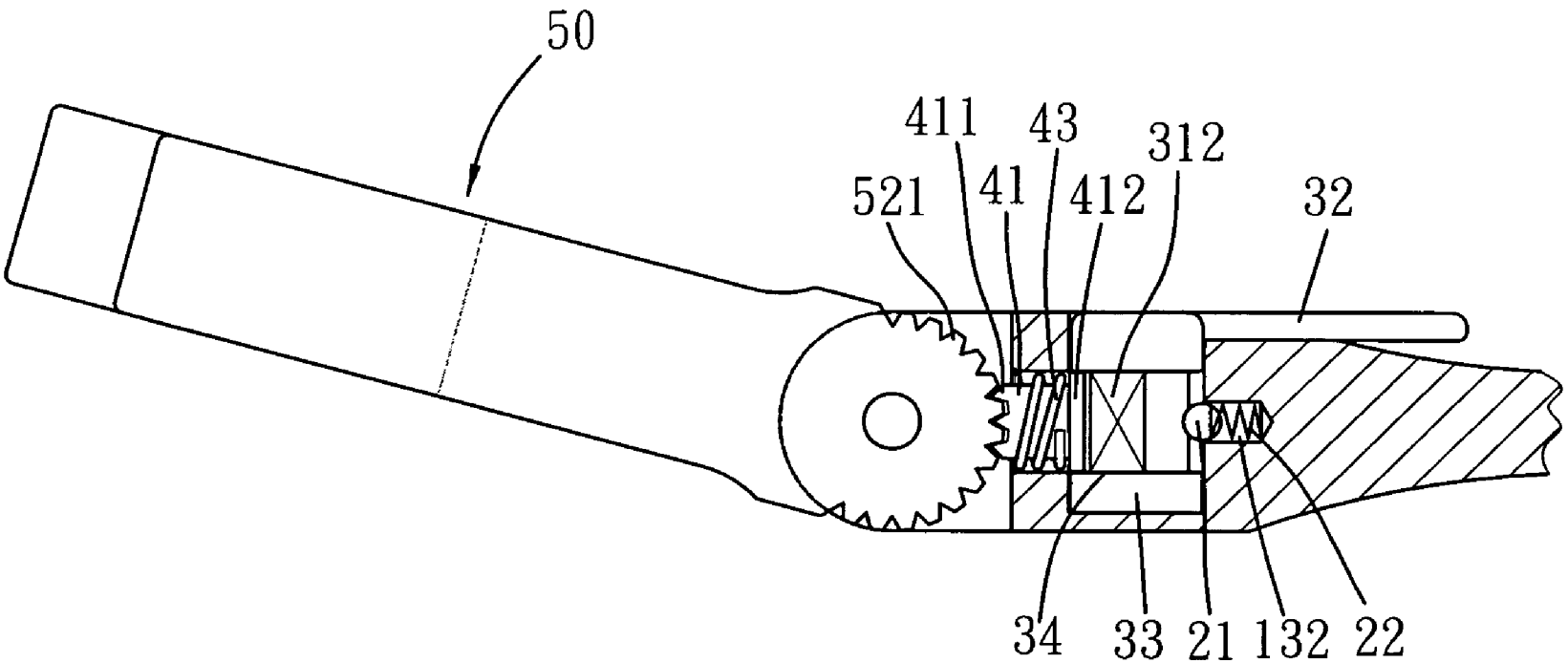
FIG. 6 shows that the pawl is engaged with the engaging teeth of the tool head when the convex and curved surface of the shank is in contact with the pawl.

A pawl set 40 includes a pawl 41 and a first spring 43, wherein the pawl 41 has teeth 411 defined in a first end thereof and a flange 412 extends radially from the second end of the pawl 41. The flange 412 of the pawl 41 is engaged between the two enlarged portions 33 of the shank 31 of the switch member 30. A ring 42 is securely engaged with the first passage 131 as shown in FIG. 4 and the first spring 43 is mounted to the pawl 41 and biased between the ring 42 and the flange 412 so as to apply a force to push the pawl 41 toward the shank 31 of the switch member 30. The pawl 41 is movably in contact with the outer periphery of the shank 31, and because the flange 412 is engaged between the two enlarged portions 33 of the shank 31, the pawl 41 can be precisely moved by the shank 31.

A tool head 50 includes an operation end 51 and an insertion 52 on two opposite ends thereof. The insertion 52 includes a through hole and a pin "C" extends through the two holes 133 of the two lugs of the yoke 12 and the through hole of the insertion 52 so that the insertion 52 is pivotbaly engaged with the space 13 of the yoke 12. The insertion 52 includes engaging teeth 521 and the teeth 411 are removably engaged with the engaging teeth 521 of the insertion 52.

A positioning set 20 is received in the second passage 132 and includes a bead 21 and a second spring 22 which pushes the bead 21 toward the shank 31 in the recess 121. Two notches 313, 314 are defined in the convex and curved surface 311, the bead 21 is engaged with one of the two notches 313, 314.

A recessed area "A" is defined in the side of the handle 10 and communicates with the recess 121. Two sidewalls "B" are defined in two insides of the recessed area "A". A depth of the recessed area "A" is equal to a thickness of the lever 32 so that the lever 32 is in flush with the top of the yoke 12 and restricted in the recessed area "A" between the two sidewalls "B". Two indexes "L" and "R" can be marked on the surface of the recessed area "A" to instruct the user to acknowledge the status of locking and unlocking for the tool head 50.

Figure 3:
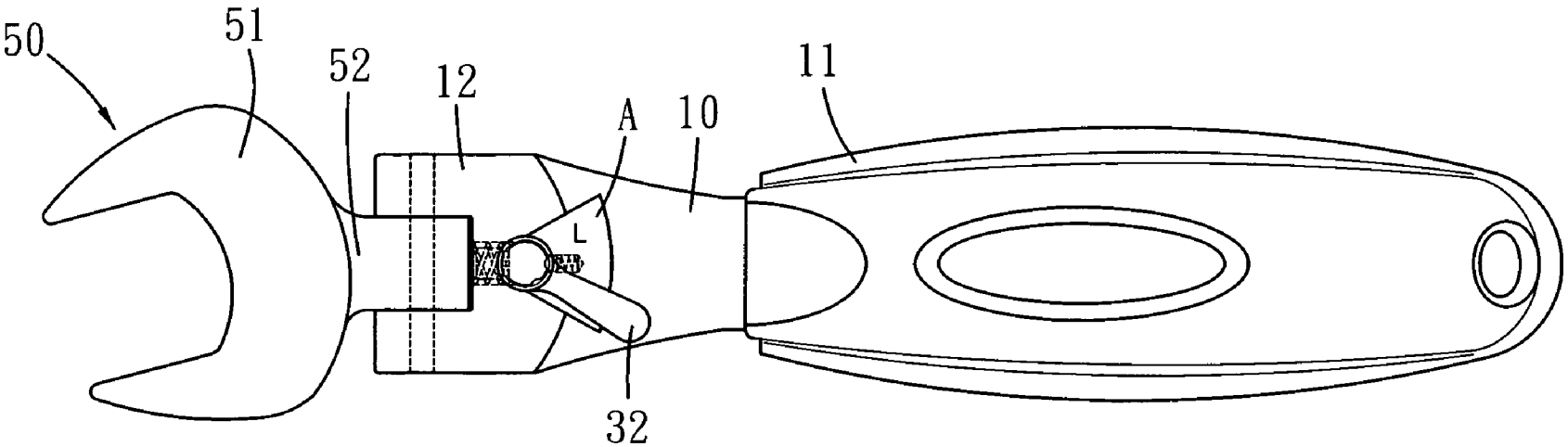
FIG. 3 is a top view to show that the lever is pivoted downward.

When the lever 32 is pivoted downward as shown in FIG. 3, the bead 21 is engaged with the notch 313 as shown in FIG. 4, and the second end of the pawl 41 is in contact with the flat surface 312 of the shank 31. In this position, the pawl 41 is withdrawn by the spring 43 and the teeth 411 are removed from the engaging teeth 521 of the insertion 52, so that the tool head 50 can be freely pivoted.

Figure 7:
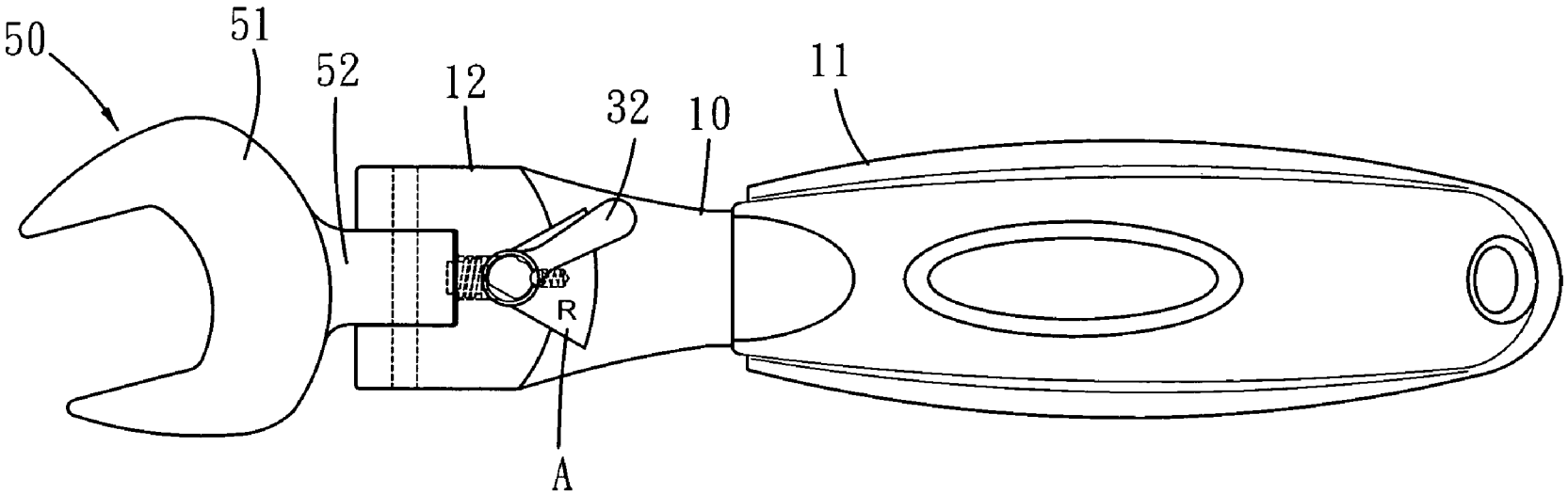
FIG. 7 shows that the lever is pivoted upward.
Figure 8:
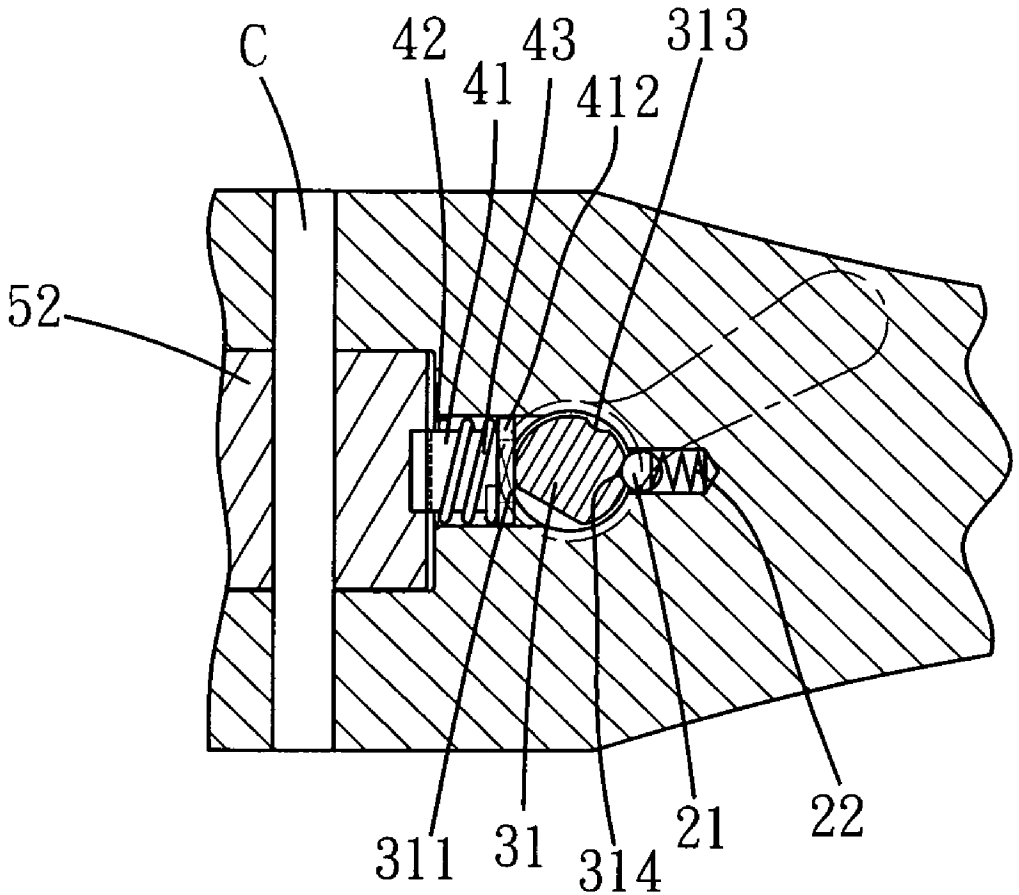
FIG. 8 is a cross sectional view to show the bead is engaged with the other one of the notches in the shank and the convex and curved surface of the shank is in contact with the pawl.

When the lever 32 is pivoted upward as shown in FIG. 7, the shank 31 is rotated an angle and the bead 21 is engaged with the other notch 314 as shown in FIG. 8, and the second end of the pawl 41 is pushed by the convex and curved surface 311 of the shank 31, the teeth 411 are engaged with the engaging teeth 521 of the insertion 52. In this position, the tool head 50 is locked.

Figure 9:
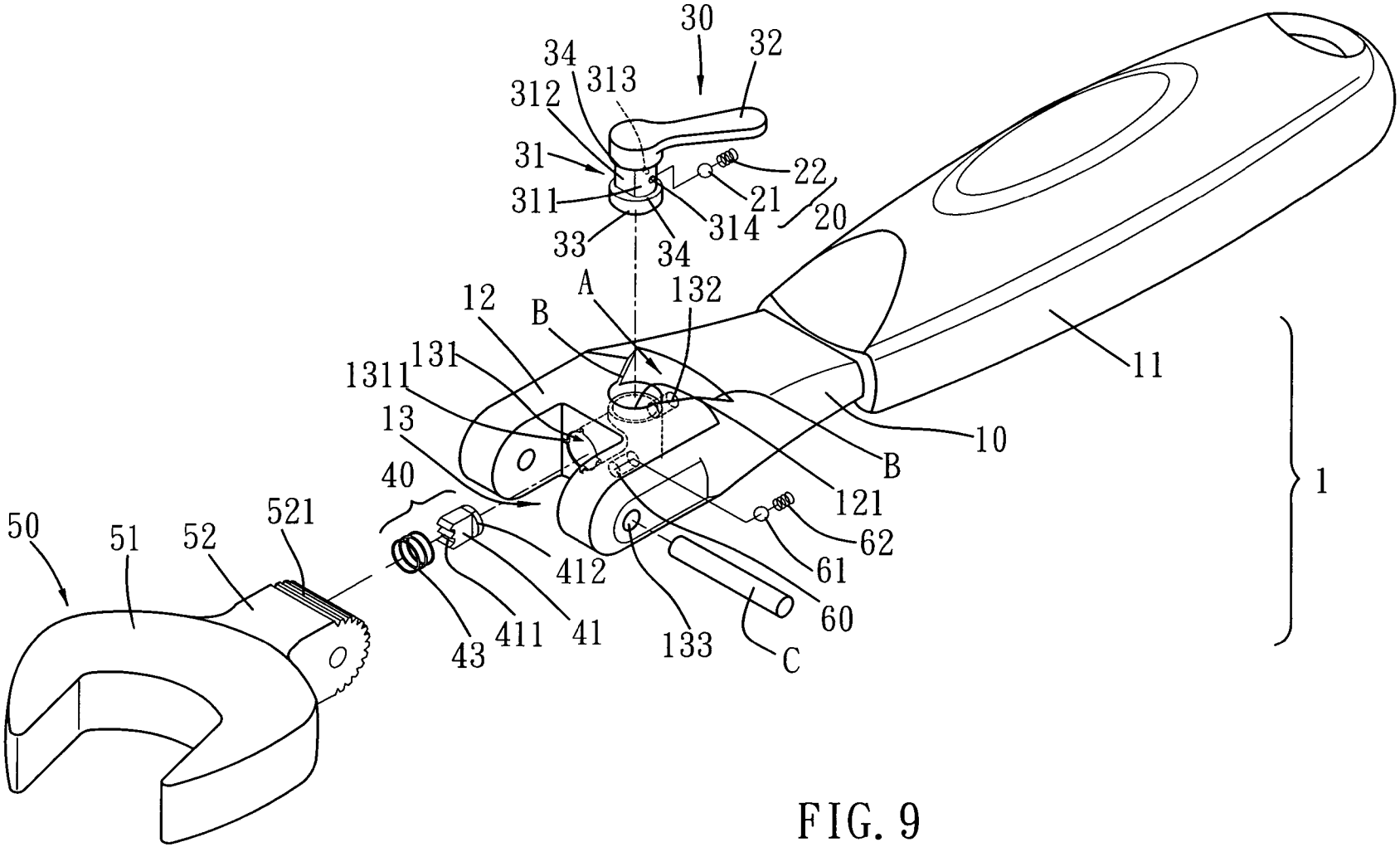
FIG. 9 is an exploded view to show another embodiment of the hand tool of the present invention.

FIG. 9 shows another embodiment of the present invention, wherein a port 60 is defined in the inside of the yoke 12 and located parallel to the first passage 131. A positioning member 61 and a third spring 62 are received in the port 60. The positioning member 61 is pushed by the third spring 62 to engage with the engaging teeth 521 of the insertion 52 of the tool head 50. The positioning member 61 is normally engaged with the engaging teeth 521 of the insertion 52 of the tool head 50 so that even when the pawl 41 is withdrawn away from the insertion 52, the tool head 50 is positioned at the position and does not pivoted down by the gravity. This is convenient for the user to adjust the tool head 50.

The ring 42 in the first embodiment is replaced by an inward flange 1311 extends inward from an inner periphery of the first passage 131 and the first spring 43 is biased between the inward flange 1311 and the flange 412.

While we have shown and described the embodiment in accordance with the present invention, it should be clear to those skilled in the art that further embodiments may be made without departing from the scope of the present invention.

What is claimed is:

1. A hand tool comprising:

a handle having a yoke on one end thereof and a space defined between two lugs of the yoke, a recess defined in one side of the handle and a first passage defined longitudinally in an inside of the yoke, the recess communicating with the passage;

a switch member having a shank which is rotatably inserted in the recess and includes a convex and curved surface and a flat surface defined in an outer periphery thereof, a lever extending from a top of the shank and located on the side of the handle;

a pawl set including a pawl and a first spring, the pawl having pawl teeth defined in a first end thereof, the first spring mounted to the pawl and applied a force to push the pawl toward the shank of the switch member, a second end of the pawl movably in contact with the outer periphery of the shank, and a tool head having an operation end and an insertion on two opposite ends thereof, the insertion pivotbaly engaged with the space of the yoke and having engaging teeth, the pawl teeth being pushed to engage with the engaging teeth of the insertion when the second end of the pawl is pushed by the convex and curved surface of the shank, the pawl teeth being removed from the engaging teeth of the insertion when the second end of the pawl is in contact with the flat surface of the shank.

2. The hand tool as claimed in claim 1, wherein a flange extends radially from the second end of the pawl and the shank includes two enlarged portions on the top and a bottom thereof, the flange of the pawl is engaged between the two enlarged portions of the shank of the switch member.

3. The hand tool as claimed in claim 1, wherein a second passage is defined longitudinally in the handle and communicates with the recess, the recess is located between the first and second passages, a positioning set is received in the second passage and includes a bead and a second spring which pushes the bead toward the shank in the recess, two notches are defined in the convex and curved surface, the bead is engaged with one of the two notches.

4. The hand tool as claimed in claim 2, wherein a ring is securely engaged with the first passage and the first spring is biased between the ring and the flange.

5. The hand tool as claimed in claim 1, wherein the insertion of the tool head includes a through hole and the two lugs of the yoke each have a hole, a pin extends through the two holes of the two lugs and the through hole of the insertion.

6. The hand tool as claimed in claim 1, wherein a recessed area is defined in the side of the handle and communicates with the recess, two sidewalls are defined in two insides of the recessed area, a depth of the recessed area is equal to a thickness of the lever.

7. The hand tool as claimed in claim 1, wherein a port is defined in the inside of the yoke and located parallel to the first passage, a positioning member and a third spring are received in the port, the positioning member is pushed by the third spring to engage with the engaging teeth of the insertion of the tool head.

8. The hand tool as claimed in claim 7, wherein a flange extends radially from the second end of the pawl and the shank includes two enlarged portions on the top and a bottom thereof, the flange of the pawl is engaged between the two enlarged portions of the shank of the switch member, an inward flange extends inward from an inner periphery of the first passage and the first spring is biased between the inward flange and the flange.

* * * * *